US010427167B2

(12) United States Patent
Ropponen et al.

(10) Patent No.: US 10,427,167 B2
(45) Date of Patent: Oct. 1, 2019

(54) DEVICE AND METHOD FOR SEPARATING WEAKLY MAGNETIC PARTICLES

(71) Applicant: Magsort Oy, Helsinki (FI)

(72) Inventors: Tommi Ropponen, Espoo (FI); Niklas Törnkvist, Kauniainen (FI)

(73) Assignee: Magsort Oy, Helsinki (FI)

( * ) Notice: Subject to any disclaimer, the term of this patent is extended or adjusted under 35 U.S.C. 154(b) by 0 days.

(21) Appl. No.: 15/575,429

(22) PCT Filed: Apr. 11, 2016

(86) PCT No.: PCT/FI2016/050230

§ 371 (c)(1),
(2) Date: Nov. 20, 2017

(87) PCT Pub. No.: WO2016/166410

PCT Pub. Date: Oct. 20, 2016

(65) Prior Publication Data

US 2018/0154371 A1 Jun. 7, 2018

(30) Foreign Application Priority Data

Apr. 14, 2015 (FI) ..... 20150118

(51) Int. Cl.
*B03C 1/18* (2006.01)
*B03C 1/005* (2006.01)
(Continued)

(52) U.S. Cl.
CPC ..... *B03C 1/18* (2013.01); *B03C 1/005* (2013.01); *B03C 1/025* (2013.01); *B03C 1/247* (2013.01); *B03C 1/26* (2013.01); *B03C 2201/20* (2013.01)

(58) Field of Classification Search
CPC .. B03C 1/18; B03C 1/26; B03C 1/005; B03C 1/025; B03C 1/247; B03C 2201/20
See application file for complete search history.

(56) References Cited

U.S. PATENT DOCUMENTS 1,729,589 A 9/1929 Mordey
3,083,830 A 4/1963 Broderick
(Continued)

FOREIGN PATENT DOCUMENTS

CN 102179296 A 9/2011
CN 202516688 U 11/2012
(Continued)

*Primary Examiner* — Joseph C Rodriguez
*Assistant Examiner* — Kalyanavenkateshware Kumar
(74) *Attorney, Agent, or Firm* — Seppo Laine Oy

(57) ABSTRACT

A device for separating weakly magnetic first particles, for example hematite particles, from mixture (912) comprising the first particles (913) and less magnetic second particles (914) is presented. The device comprises first magnetizing equipment (901) for producing magnetic field and for moving the mixture so that mutually opposite polarity portions (N, S) of the magnetic field sweep the mixture in a sweeping direction and thereby deflect the direction of movement of the first particles towards the sweeping direction and away from the direction of movement of the second particles. The device comprises also a supply equipment (932) for supplying the mixture to the carrier equipment with the aid of gravitation and a second magnetizing equipment (931) connected to a feed box (920) for producing second magnetic field for deflecting a direction of movement of the first particles differently than a direction of movement of the second particles when the mixture is moved by the gravitation towards the carrier equipment so as to generate, to the mixture arriving at the carrier equipment, a concentration gradient of the first particles. The pre-concentration of the first particles simplifies their separation form the mixture.

10 Claims, 12 Drawing Sheets

(51) Int. Cl.

| | |
|---|---|
| ***B03C 1/025*** | (2006.01) |
| ***B03C 1/247*** | (2006.01) |
| ***B03C 1/26*** | (2006.01) |

(56) References Cited

U.S. PATENT DOCUMENTS

| | | | | |
|---|---|---|---|---|
| 3,595,386 | A * | 7/1971 | Hradel | B03C 1/002 209/214 |
| 3,950,661 | A | 4/1976 | Langmuir | |
| 4,659,457 | A | 4/1987 | Martinez | |
| 6,041,942 | A | 3/2000 | Goolsby | |
| 6,318,558 | B1 | 11/2001 | Exner | |
| 2003/0196935 | A1 | 10/2003 | Miles et al. | |
| 2012/0279906 | A1 | 11/2012 | Masferrer Salas | |
| 2013/0161240 | A1 | 6/2013 | Koslow | |
| 2013/0256198 | A1 * | 10/2013 | Ellis | B03C 1/286 209/3.1 |

FOREIGN PATENT DOCUMENTS

| | | | |
|---|---|---|---|
| DE | 19634802 | A1 | 11/1997 |
| WO | WO2015052368 | A1 | 4/2015 |

* cited by examiner

DEVICE AND METHOD FOR SEPARATING WEAKLY MAGNETIC PARTICLES

FIELD

The present disclosure relates to a device and to a method for separating weakly magnetic particles from a mixture comprising particles having different magnetic susceptibility. The mixture may comprise for example hematite, ilmenite or pyrrhotite.

BACKGROUND

An exemplary device for separating paramagnetic materials (the first particles) such as hematite $Fe_2O_3$, ilmenite $FeTiO_3$ or pyrrhotite having positive magnetic susceptibility from mixture comprising the first particles and less magnetic second particles is shown in FIGS. 1*a-c*. In these figures, the first particles are presented as white circles one of which is denoted with a reference number 113 and the second particles are presented as black circles one of which is denoted with a reference number 114. The device includes magnetizing equipment 101 for producing magnetic field acting on the mixture, carrier equipment 102 for carrying the mixture so that the mixture is adapted to move with respect to the magnetic field. The magnetizing equipment and the carrier equipment are adapted to produce the magnetic field and to carry the mixture, respectively, so that mutually opposite polarity portions of the magnetic field are adapted to sweep the mixture in a sweeping direction and thereby deflect the direction of movement of the first particles towards the sweeping direction and away from the direction of movement of the second particles so that the deflected direction of movement of the first particles intersects the sweeping direction. The deflected direction of movement of the first particles makes it possible to receive the first and second particles with separate collectors 131-133. As each particle of the mixture can be repetitively swept by the portions of the magnetic field having the mutually opposite polarities, the magnetic force caused by the sweeping is directed to each of the particles many times.

In the exemplifying device illustrated in FIGS. 1*a-c*, the carrier equipment 102 comprises a conveyor belt 109 driven with an electrical motor 119. The longitudinal direction of the conveyor belt 109 is substantially parallel with a rotation axis of each of the rotating elements 103-106 driven with electrical motors 122 and 123. The conveyor belt is adapted to receive the mixture 112 from a feed box 120 and to move the mixture so that the mixture is a distance away from magnetizing equipment producing the magnetic field. The direction of the movement of the conveyor belt 109 is depicted with an arrow 130 in FIG. 1*b*.

An enlargement of the feed box of the device of FIGS. 1*a* and 1*b* is shown in FIG. 1*c*. As seen from the FIG. 1*c*, the first and the second particles are randomly distributed in the mixture 112. When the particles are allowed to fall from the feed box 120 to the conveyor belt 109, they give rise to a randomly organized mixture wherein some of the first particles are on the top of the mixture while some other of the first particles are in the bottom of the mixture. If the first particles to be separated are heavier than the second particles, they are prone to fall at the bottom of the mixture.

As seen from FIG. 1*b*, the first and second particles start to separate only after reaching the magnetizing equipments 103 and 104. Accordingly, their separation may be challenging especially when high speed of the conveyor belt and relatively weak magnetic fields are used, and when a mixture comprising plurality of particles of different magnetic susceptibility need to be separated. Thus there is a need for making their separation more effective.

US 2013/016240A1 discloses a device and a method for separating non-ferrous material. The document teaches separating any ferrous material present by using eddy current, and further separation of weakly magnetic material on a device equipped with a slowly running conveyor belt and slowly rotating discs comprising plurality of permanent magnets.

US 2012/279906A1 discloses a magnetic roller type separating device comprising neodymium magnets. The device is suitable for ore concentration.

U.S. Pat. No. 1,729,589 discloses a device and method for separation and concentration of minerals of an ore. The device comprises a feed box for the ore, and plurality of electro-magnets for deflecting the direction of movement of the ore particles based on their magnetic susceptibility. The magnets are located either below the feed box or below a non-magnetic launder.

U.S. Pat. No. 4,659,457 discloses an ore separator for concentrating magnetic or weakly magnetic minerals having a relatively high specific gravity. The separator utilizes codirectional magnetic and gravitational forces to achieve separation.

U.S. Pat. No. 6,041,942 discloses an apparatus for magnetically separating cracking catalysts comprising a flexible continuous woven aromatic polyamide fiber belt movable around first and second rollers opposite ends thereof for receiving a catalyst stream on an upper surface thereof, wherein one of the rollers comprise a plurality of stacked radial magnetic discs with poles facing each other to provide a concentrated magnetic field to influence particles in the catalyst stream having magnetic properties.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying and non-limiting embodiments of the invention.

In accordance with the invention, there is provided a new a device for separating first particles from a mixture comprising the concentration gradient. The particles of the mixture can be, for example but not necessarily, hematite, ilmenite, ilmenite, pyrrhotite, siderite, chromite, biotite and quartz sand.

According to one aspect, the present invention concerns a device for separating first particles from mixture comprising the first particles and second particles, each of the first particles having positive magnetic susceptibility and each of the second particles having magnetic susceptibility smaller than that of each of the first particles, the device comprising:

- first magnetizing equipment for producing first magnetic field acting on the mixture,
- carrier equipment for carrying the mixture so that the mixture is adapted to move with respect to the first magnetic field.

In accordance with the invention, the device comprises a supply equipment comprising a feed box and a second magnetizing equipment for supplying the mixture to the carrier equipment with the aid of gravitation and magnetic force. The second magnetizing equipment is connected to the feed box.

The first magnetizing equipment and the carrier equipment are adapted to produce the first magnetic field and to carry the mixture so that mutually opposite polarity portions of the first magnetic field are adapted to sweep the mixture in a sweeping direction and deflect a direction of movement of the first particles towards the sweeping direction and away from a direction of movement of the second particles, the deflected direction of movement of the first particles intersecting the sweeping direction.

The supply equipment comprises a feed box comprising second magnetizing equipment for producing second magnetic field for deflecting a direction of movement of the first particles differently than a direction of movement of the second particles when the mixture is moved by the gravitation towards the carrier equipment so as to generate, to the mixture arriving at the carrier equipment, a concentration gradient of the first particles.

In accordance with the invention, there is provided also a new method for separating first particles from mixture comprising the first particles and second particles, each of the first particles having positive magnetic susceptibility and each of the second particles having magnetic susceptibility smaller than that of each of the first particles, the method comprising:

supplying the mixture to a carrier equipment from a feed box with aid of gravitation, producing first magnetic field acting on the mixture on the carrier equipment, moving the mixture with respect to the first magnetic field, wherein the producing the first magnetic field and the moving the mixture with respect to the first magnetic field are carried out so that mutually opposite polarity portions of the magnetic field sweep the mixture in a sweeping direction and deflect a direction of movement of the first particles towards the sweeping direction and away from a direction of movement of the second particles, the deflected direction of movement of the first particles intersecting the sweeping direction, and wherein the method further comprising producing second magnetic field within the feed box acting on the mixture and deflecting a direction of movement of the first particles differently than a direction of movement of the second particles when supplying the mixture by the gravitation towards the carrier equipment.

A number of exemplifying and non-limiting embodiments of the invention are described in accompanied dependent claims.

Various exemplifying and non-limiting embodiments of the invention both as to constructions and to methods of operation, together with additional objects and advantages thereof, will be best understood from the following description of specific exemplifying embodiments when read in connection with the accompanying drawings.

The verbs "to comprise" and "to include" are used in this document as open limitations that neither exclude nor require the existence of also un-recited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

Exemplifying and non-limiting embodiments of the invention and their advantages are explained in greater detail below with reference to the accompanying drawings, in which.

DESCRIPTION OF EXEMPLIFYING EMBODIMENTS

Figure 1A:
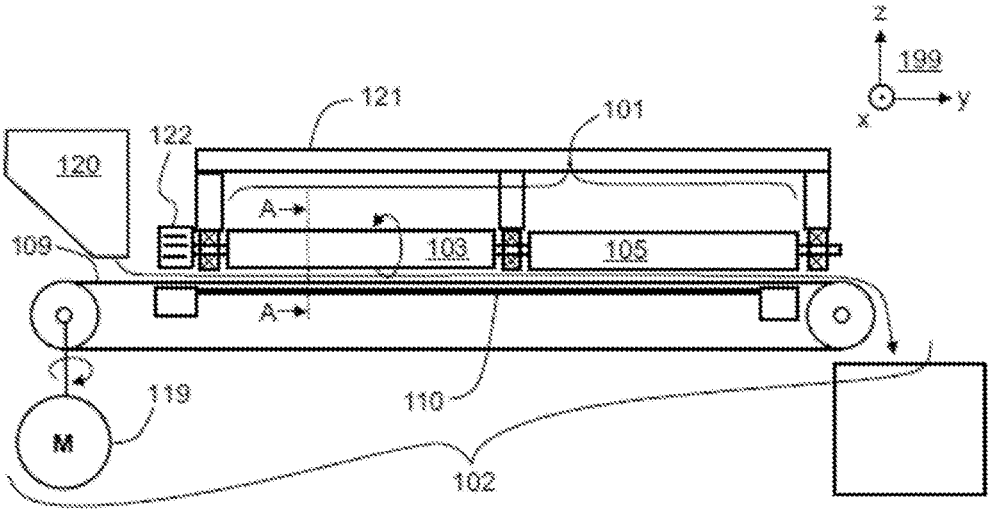
FIG. 1*a* shows a schematic side view of a prior art device for separating particles having positive magnetic susceptibility from less magnetic particles.

The term concentrating should be understood as subjecting the mixture to gravity force and magnetic field so that the mole fraction of specific particles will be larger at a specific location of the mixture than prior to the subjecting. The term concentration gradient should be understood as a gradual difference in concentration of the particles in a mixture between a region of high density and one of lower density. In the present disclosure the terms concentrating and generating a concentration gradient have the same meaning.

It should be understood that the first particles need not to have the same magnetic susceptibility. Exemplary first particles are hematite, ilmenite, ilmenite, pyrrhotite, siderite, chromite, biotite. The mixture can include one or more first particles and one or more second particles. According to an exemplary embodiment the first particles are hematite and ilmenite, and the second particles are biotite. According to another exemplary embodiment the first particles are hematite and the second particles are quartz sand.

According to one embodiment the device of the present invention is suitable for separating first particles from mixture comprising the first particles and second particles, each of the first particles having positive magnetic susceptibility and each of the second particles having magnetic susceptibility smaller than that of each of the first particles, the device comprising:

first magnetizing equipment (801, 901, 1001, 1101, 1201) for producing first magnetic field acting on the mixture, carrier equipment (202, 702, 802, 902, 1102, 1202) for carrying the mixture so that the mixture is adapted to move with respect to the first magnetic field, supply equipment (232, 432, 732, 832, 932) comprising a feed box (220, 420, 620, 720, 820, 920) for supplying the mixture to the carrier equipment with the aid of gravitation, wherein the first magnetizing equipment and the carrier equipment are adapted to produce the first magnetic field and to carry the mixture so that mutually opposite polarity portions of the first magnetic field are adapted to sweep the mixture in a sweeping direction and deflect a direction of movement of the first particles towards the sweeping direction and away from a direction of movement of the second particles, the deflected direction of movement of the first particles intersecting the sweeping direction, and wherein the feed box comprises second magnetizing equipment (231, 431,731, 831, 931), for producing second magnetic field and for deflecting a direction of movement of the first particles differently than a direction of movement of the second particles when the mixture is moved by the gravitation towards the carrier equipment so as to generate, to the mixture arriving at the carrier equipment, a gradient of concentration of the first particles.

Exemplary devices according to the present invention have been shown in FIGS. 2, 4-7 and 9-12. For sake of clarity the mixtures shown in the figures include only first particles and second particles, which are magnetic and practically nonmagnetic, respectively.

Figure 2:
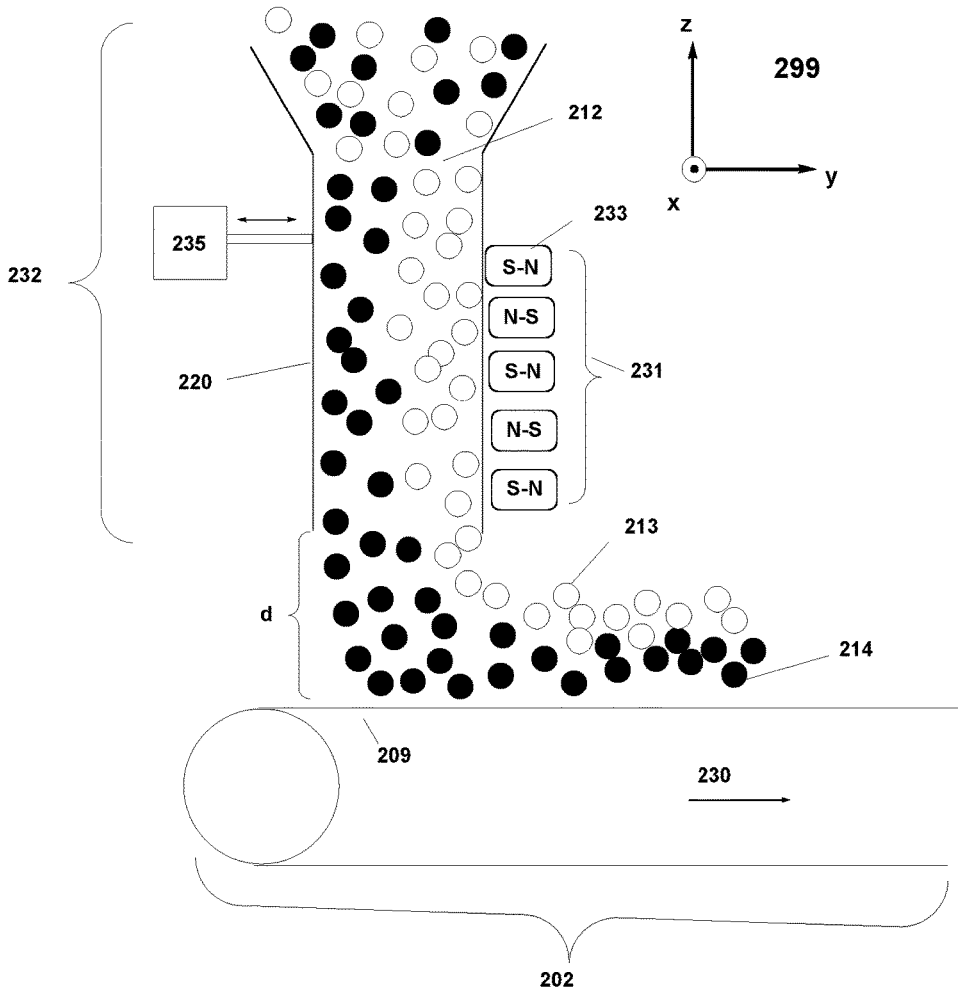

FIG. 2 shows a schematic side view of device according to an exemplifying and non-limiting embodiment of the invention. Furthermore, the figure shows schematically a mixture 212 which comprises first particles having positive magnetic susceptibility, $\chi>0$, and less magnetic second particles. The first particles can be, for example but not necessarily, hematite, ilmenite or pyrrhotite and the second particles can be for example quartz sand. In FIG. 2, the first particles are presented as white circles one of which is denoted with a reference number 213 and the second particles are presented as black circles one of which is denoted with a reference number 214. As seen from the figure, the mixture is initially randomly distributed in the feed box 220 of the supply equipment 232.

In the exemplifying device illustrated in FIG. 2, the feed box 220 includes a second magnetizing equipment 231, including plurality of magnets 233. The magnets are positioned so that the deflection of the direction of falling of the first particles is upstream in respect to the direction of the movement of the conveyor belt 209 shown with the arrow 230 i.e. in the y-direction of the coordinate system 299. According to this embodiment the first particles are concentrated on the top of the mixture on a moving conveyor belt 209 since they are moved towards the second magnetizing equipment more strongly than the less magnetic second particles.

Figure 3:
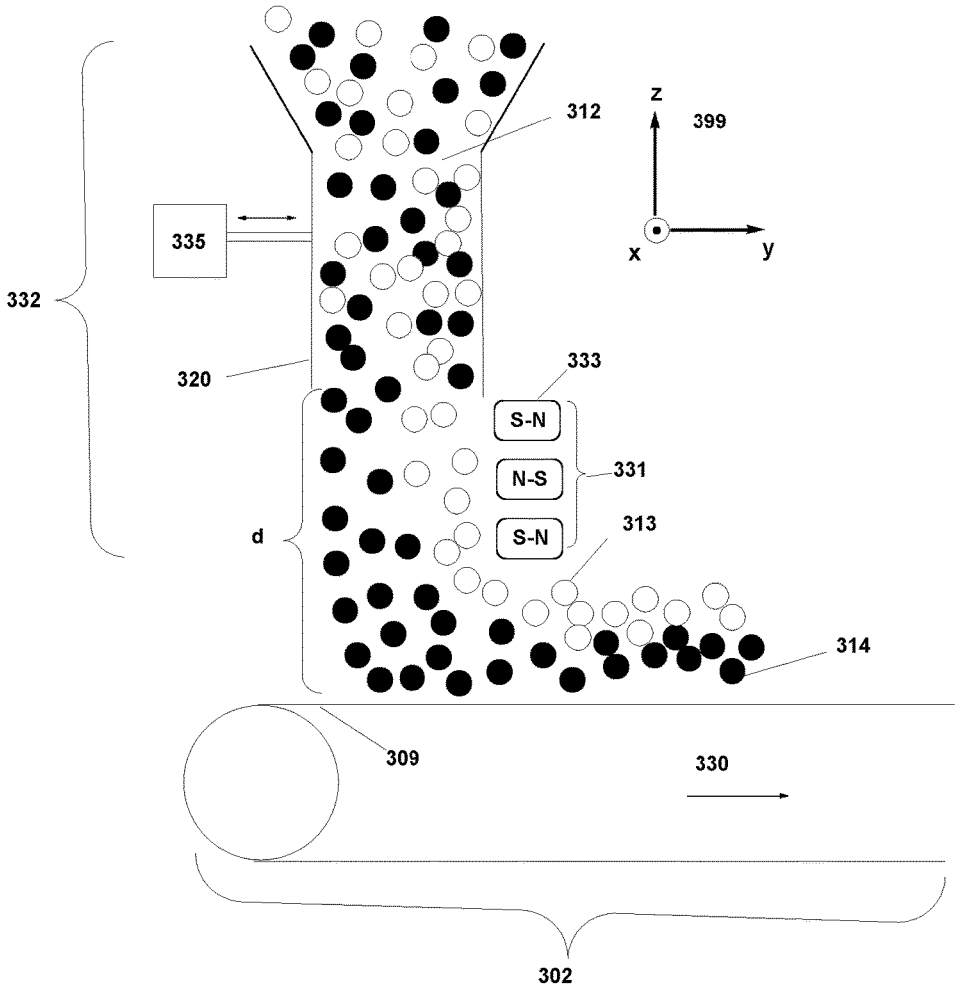
FIG. 3 illustrates a supply equipment and carrier equipment for separation of first particles in a mixture having the first particles having positive magnetic susceptibility and less magnetic second particles, wherein the second magnetizing equipment is not connected to the feed box.

FIG. 3 shows a schematic side view of device wherein the second magnetizing equipment 331 is below the feed box 320, and thus the deflection of direction of falling the particles having magnetic susceptibility occurs outside the feed box. Accordingly, the first particles should also be concentrated on the top of the mixture on a moving conveyor belt 309, since they are moved towards the second magnetizing equipment more strongly than the less magnetic second particles.

However, there are significant differences between the devices according to FIGS. 2 and 3.

Referring to FIG. 2, falling of the first and the second particles within the feed box 220 causes a laminar flow. When the laminar flow of the falling particles are subjected to a magnetic field produced by the second magnetizing equipment 231, the magnetic field deflects the direction of the falling first particles to y-direction of the coordinate system 299, and a concentration gradient of the particles is formed on the moving conveyor belt. To assist the formation of smooth concentration gradient, the feed box should sufficiently close to the conveyor belt, i.e. the distance (d) for free falling should be as short as possible.

Referring to FIG. 3, the particles falling in the feed box 320 cause also a laminar flow. However, after the feed box, particles fall freely, and the freely falling particles are subjected to a magnetic field outside the feed box. Accordingly, the subjecting to the magnetic field to the fast falling particles is not as effective as by using the device of the present invention. Since the distance (d) is longer than in the case of the device according to FIG. 2, the fast falling first and second particles are also more prone to jumping when hitting the conveyor or the material on the conveyor belt. This in turn, makes the concentrating is less efficient.

Figure 4:
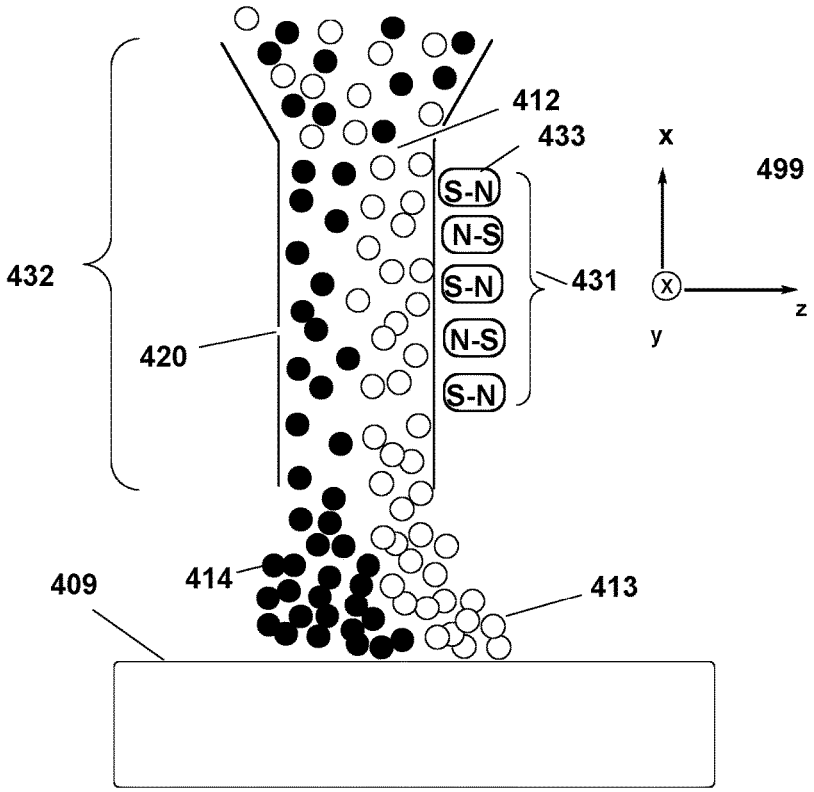

FIG. 4 shows schematic side view of another device according to an exemplifying and non-limiting embodiment of the invention. Furthermore, the figure shows schematically mixture 412 which comprises first particles having positive magnetic susceptibility, $\chi>0$, and less magnetic second particles. The first particles can be, for example but not necessarily, hematite, ilmenite or pyrrhotite and the second particles can be for example quartz sand. In FIG. 4, the first particles are presented as white circles one of which is denoted with a reference number 413 and the second particles are presented as black circles one of which is denoted with a reference number 414. In the exemplifying device illustrated in FIG. 4, the feed box 420 includes a second magnetizing equipment 431, including plurality of magnets 433. The magnets are positioned perpendicular in respect to the direction of the movement of the conveyor belt 409 i.e. in the z-direction of the coordinate system 499. According to this embodiment, the first particles are concentrated on one side of the mixture.

Figure 5:
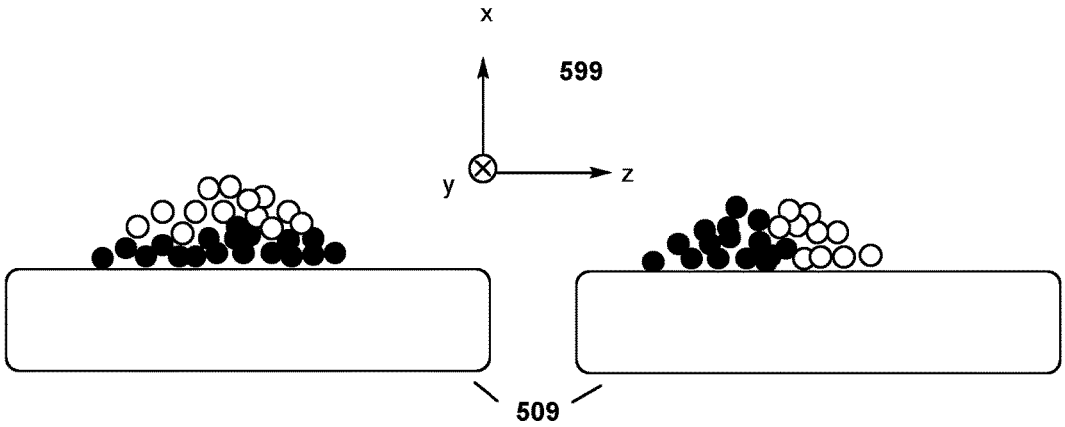
FIG. 5 illustrates a concentration gradient of the first particles from a mixture on a conveyor belt, when the concentration has been done with the device according to FIG. 2 and FIG. 4.

FIG. 5 shows the effect of the position of the second magnetizing equipment of the devices according the present invention on the concentration of the first particles in the mixture. In the figure, the direction of movement of the conveyor belt is in the y-direction of the coordinate system 599. In FIG. 5, the mixture in left and right is concentrated by using devices of shown in FIGS. 2 and 4, respectively.

Figure 6:
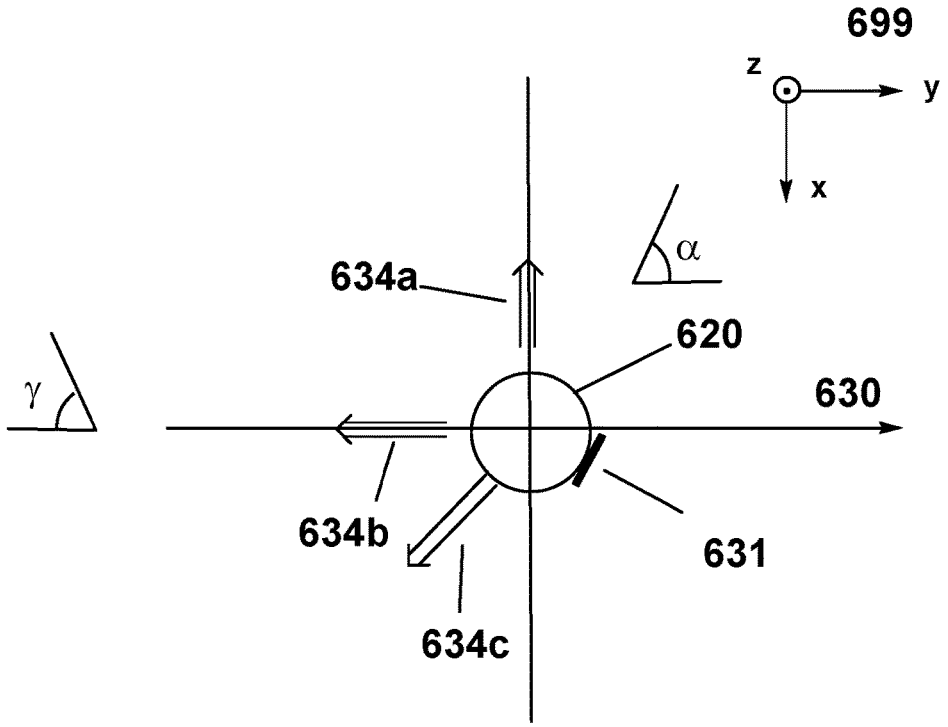
FIG. 6 shows a schematic top view of a feed box according to an exemplifying and non-limiting embodiment of the invention.

FIG. 6 shows a schematic top view of a feed box of a device according to an exemplifying and non-limiting embodiment of the invention. The feed box 620 includes a second magnetizing equipment 631 for producing second magnetic field acting on the mixture. The reference number 630 shows the direction of moving of the mixture on the carrier equipment. According to a preferable embodiment, the magnetizing equipment 631 is positioned so that the direction of deflection of the first particles is upstream or perpendicular in respect to direction of moving of the mixture on the carrier equipment. Accordingly, the concentration gradient of the first particles is towards surface of the mixture on the carrier equipment. Thus, angle $\alpha$ shown in FIG. 6 is $-90° \leq \alpha \leq 90°$, wherein $\pm 90°$ represents the situation, wherein the direction of deflection is perpendicular, and $-90° < \alpha < 90$ represents the situation, wherein the direction of deflection is upstream in respect to the direction of moving of the mixture on the carrier equipment.

According to another embodiment the feed box comprising the second magnetizing equipment is inclined so that the direction of inclination is downstream or perpendicular in respect to the direction of moving of the mixture on the carrier equipment. Accordingly, the angle $\gamma$ shown in FIG. 6 is $-90° \leq \gamma \leq 90°$, wherein $\pm 90°$ represents the situation, wherein the direction of inclination is perpendicular, and $-90° < \gamma < 90$ represents the situation, wherein the direction of inclination is downstream in respect to the direction of moving of the mixture on the carrier equipment. In the figure, the arrow with reference number 634*a*, 634*b* and 634*c* shows exemplary situations, wherein the direction of inclination $\gamma$ is 90°, 0°, and −45°, respectively.

The advantage of the inclination is that the mixture is subjected also to gravitation gradient which further assists the separation of the particles. However, it is preferable that the deflection of the falling mixture is upstream or perpendicular in respect to the moving of the mixture on the carrier equipment.

Figure 7:
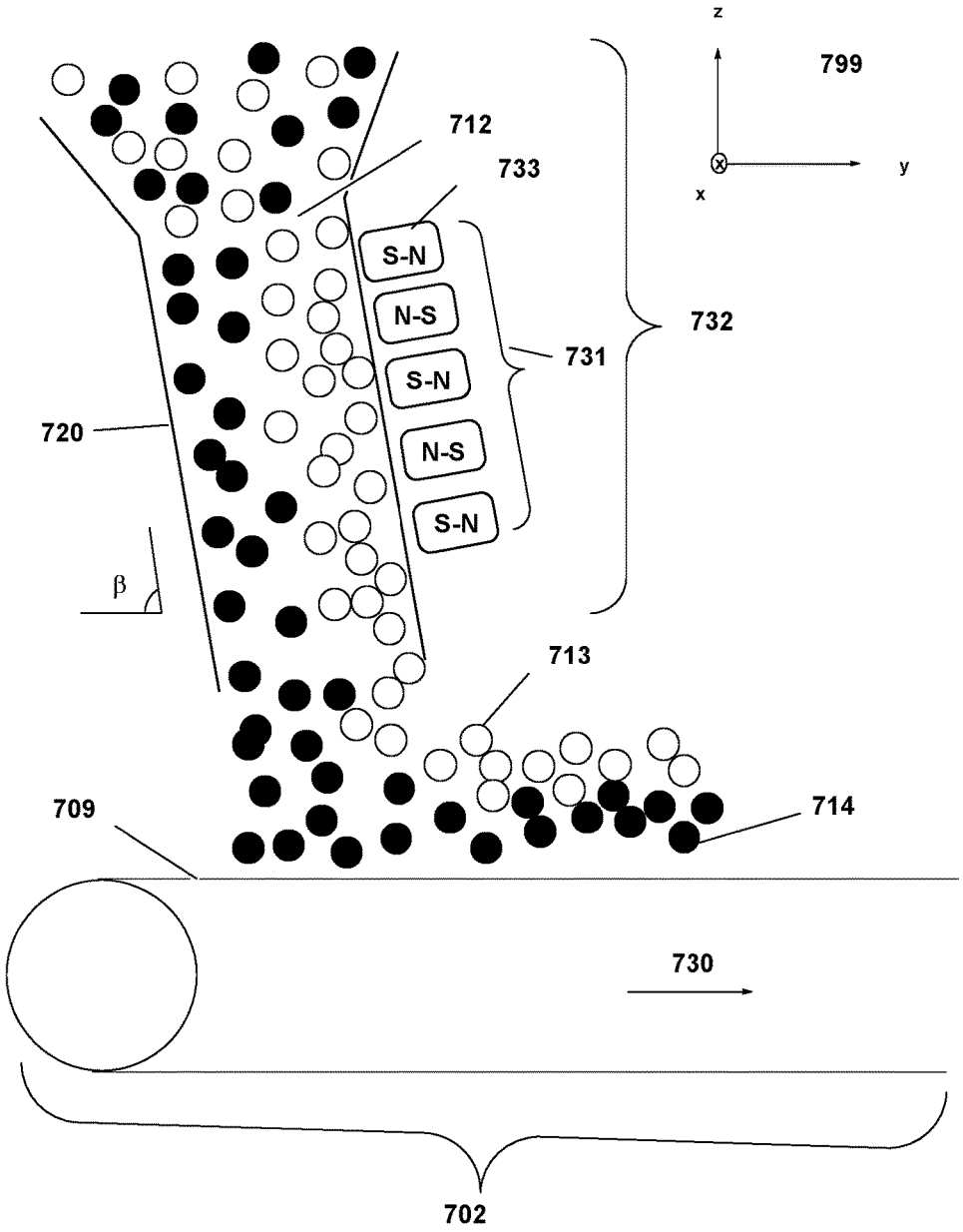
FIG. 7 illustrates a device according to an exemplifying and non-limiting embodiment of the invention for separation of first particles from a mixture having the first particles having positive magnetic susceptibility and less magnetic second particles.

FIG. 7 shows another schematic side view of a device according to an exemplifying and non-limiting embodiment of the invention. Furthermore, the figure shows schematically mixture 712 which comprises first particles having positive magnetic susceptibility, $\chi > 0$, and less magnetic second particles. The first particles can be, for example but not necessarily, hematite, ilmenite or pyrrhotite and the second particles can be for example quartz sand. In FIG. 7, the first particles are presented as white circles one of which is denoted with a reference number 713 and the second particles are presented as black circles one of which is denoted with a reference number 714. In the exemplifying device illustrated in FIG. 7, the supply equipment 732 comprises a feed box 720 and a second magnetizing equipment 731, including plurality of magnets 733. The magnets are positioned to the direction of the movement of the conveyor belt 709 shown with the arrow 730 i.e. in the y-direction of the coordinate system 799. According to this embodiment the first particles are concentrated on the top of the mixture on the moving conveyor belt. In addition, the feed box is inclined so that the direction of inclination is opposite to the direction of the moving conveyor belt (i.e. the angle $\gamma$ shown in FIG. 6 is) 0°.

In FIG. 7, the feed box is inclined upstream in respect to moving of the mixture on the carrier equipment. The angle of inclination $\beta$, shown in the figure, is $90° < \beta < 180°$, preferably $100° \leq \beta \leq 135°$, wherein $\beta$ is defined as an angle between the surface of the carrier equipment and direction of gravity when the device is at its operational position.

The second magnetizing equipment comprises one or more magnets which can be electric magnets or permanent magnets. According to an exemplary embodiment the magnet is a permanent bar magnet. According to another exemplary embodiment, the second magnetizing equipment comprises plurality of permanent magnets. Exemplary magnets have an S-N-S-N geometry. This type of magnetizing equipment are easy to construct and they give rise to even magnetic field. The permanent magnets can be embedded to a support matrix made of non-ferromagnetic material for example aluminum. Each element may further comprise a ferromagnetic yoke and a support band for supporting and protecting the permanent magnets. The support band can be made of for example carbon fiber or metal.

The second magnetizing equipment may be configured to generate homogenous or non-homogenous magnetic field, such as a magnetic gradient.

According to the invention, the direction of falling of the first particles is towards the second magnetizing equipment and away from direction of falling of the second particles when the second particles are non-magnetic. When the mixture comprises plurality of particles with different magnetic susceptibility, the deflection of direction of falling towards the magnetizing equipment is dependent on the magnetic susceptibility of the particles. When the second particles are also magnetic but their magnetic susceptibility is smaller than the magnetic susceptibility of the first particles, direction of falling of the first particles and the second particles are towards the magnetizing equipment, but the direction of falling of the first particles is deflected more strongly than the direction of falling of the second particles.

According to a preferable embodiment the supply equipment comprises also an agitator 235, 335 for agitating the mixture in the feed box. Agitating is preferable especially when the mixture is finely grounded, and the second magnetizing equipment is in contact with the feed box as in the device shown in FIG. 2. The agitating avoids or at least alleviates blocking of the feed box and also assists the movement of the particles with magnetic susceptibility towards the magnetizing equipment by causing a flow of the mixture within the feed box. This is not possible if the second magnetizing equipment 331 is below the feed box as in the device shown in FIG. 3, wherein the first particles may stick the magnets.

A peak value of magnetic flux density acting on the mixture is preferably from 0.01 T to 0.5 T. Too high magnetic field should be avoided to prevent the particles with magnetic susceptibility to stick to the magnetizing equipment. The sticking can also be avoided by agitating the feed box.

Figure 8:
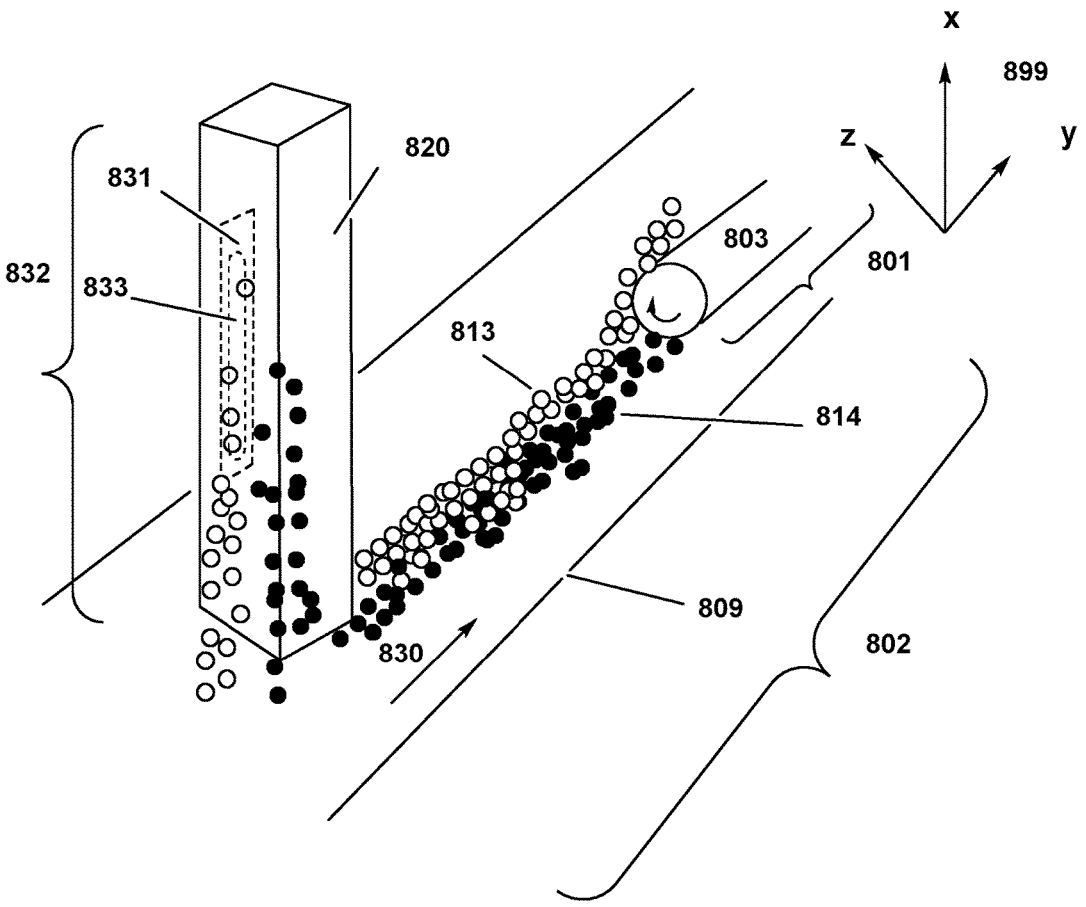
FIG. 8 illustrates another device according to an exemplifying and non-limiting embodiment of the invention for separation of first particles from a mixture having the first particles having positive magnetic susceptibility and less magnetic second particles.

An exemplary device for separating first particles from mixture comprising the first particles and second particles, each of the first particles having positive magnetic susceptibility and each of the second particles having magnetic susceptibility smaller than that of each of the first particles is shown in FIG. 8. FIG. 8 shows schematically the mixture which comprises first particles having positive magnetic susceptibility, $\chi > 0$, and less magnetic second particles. The first particles can be, for example but not necessarily, hematite, ilmenite or pyrrhotite and the second particles can be for example quartz sand. In FIG. 8, the first particles are presented as white circles one of which is denoted with a reference number 813 and the second particles are presented as black circles one of which is denoted with a reference number 814. In the exemplifying device illustrated in FIG. 8, the supply equipment 832 comprises a second magnetizing equipment 831 comprising a magnet 833 embedded to the feed box 820. The second magnetizing equipment is positioned so that the second magnetic field deflects direction of falling of the first particles perpendicular to the direction of moving of the mixture on the carrier equipment 802 shown with the arrow 830 i.e. in the z-direction of the coordinate system 899. According to this embodiment the angle $\alpha$, shown in FIG. 6, is 90 degrees, i.e. the first particles are subjected to the second magnetic field so that the first particles are concentrated on one side of the mixture on the conveyor belt.

The carrier equipment 802 comprises a conveyor belt 809 driven with an electrical motor (not shown). The longitudinal direction of the conveyor belt 809 is substantially parallel with a rotation axis of the rotation element 803 of the first magnetizing equipment 801.

The conveyor belt 809 is adapted to receive the mixture comprising a concentration gradient of the first particles from the feed box 820 of the supply equipment 832 and to move the mixture so that the mixture is a distance away from magnetizing equipment producing the magnetic field, i.e. the mixture does not touch the rotatable element 803. The direction of the movement of the conveyor belt 809 is depicted with an arrow 830 in FIG. 8.

As illustrated in FIG. 8, the sweeping magnetic field produced by the rotatable element 803 deflects the direction of movement of the first particles obliquely towards a first longitudinal edge of the conveyor belt 809. The deflected directions of movement of the first particles make it possible to collect the first particles e.g. to a collector as desired. The second particles whose direction of movement is not deflected can be collected to a separate collector.

Figure 9A:
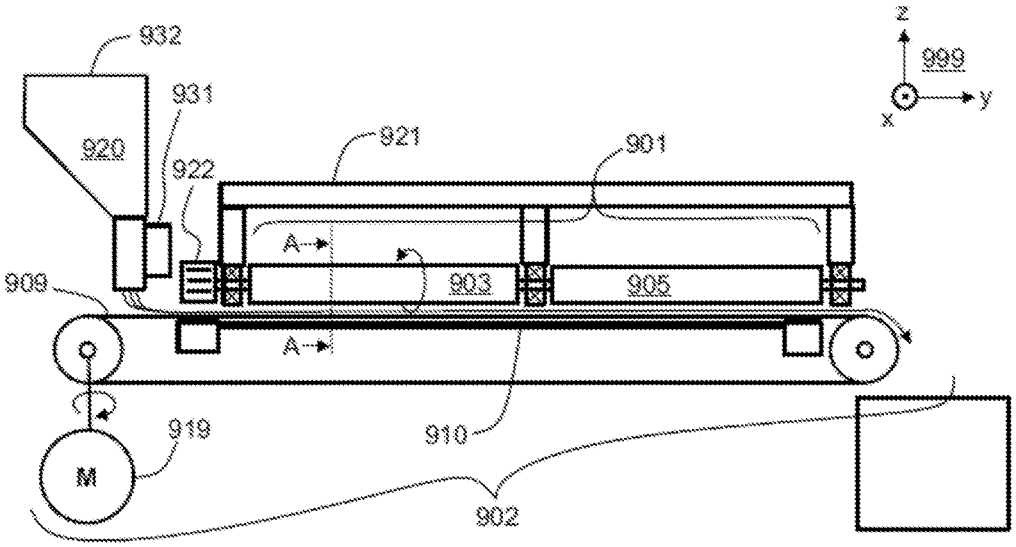
FIG. 9*a* shows a schematic side view of a device according to an exemplifying and non-limiting embodiment of the invention for separation of first particles from a mixture having the first particles having positive magnetic susceptibility and less magnetic second particles.
Figure 9B:
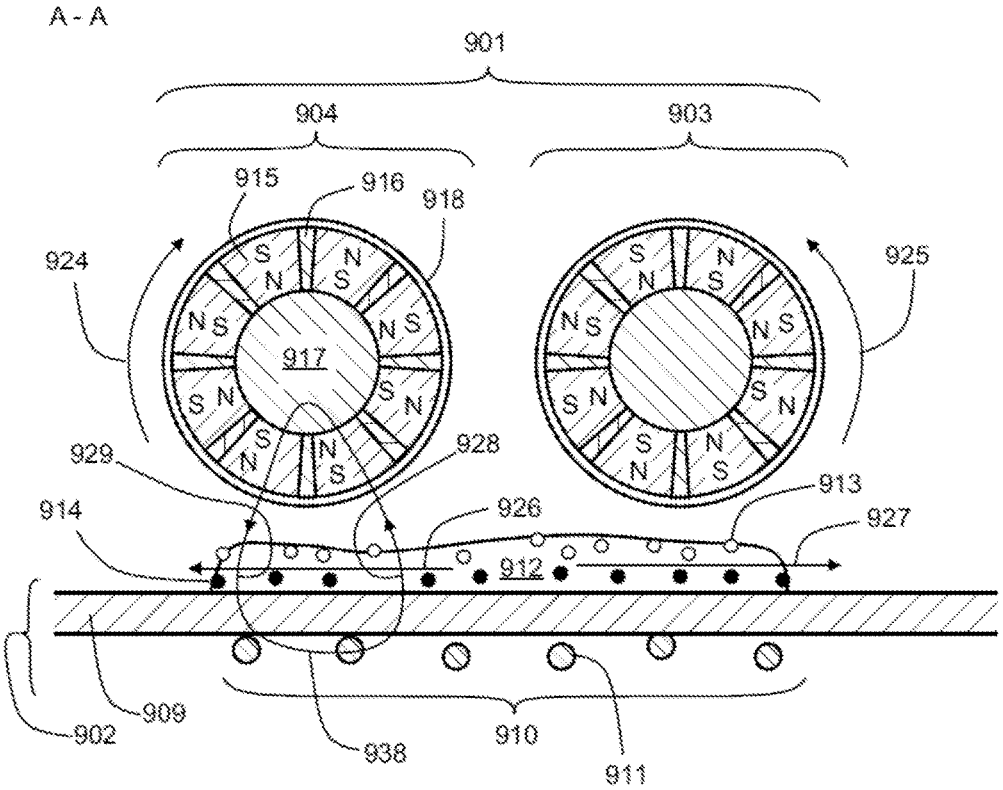
FIG. 9*b* shows a schematic view of a section taken along a line A-A shown in FIG. 9*a*.

FIG. 9*a* shows a schematic side view of a device separating weakly magnetic particles according to another exemplary embodiment of the present invention. FIG. 9*b* shows a schematic view of a section taken along a line A-A shown in FIG. 9*a*. The section plane is parallel with the xz-plane of a coordinate system 999. The device comprises the first magnetizing equipment 901 for producing magnetic field acting on the mixture 912 and carrier equipment 902, driven by an electric motor 919, for carrying the mixture comprising a concentration gradient of the first particles so that the mixture is adapted to move with respect to the magnetic field.

In the exemplifying device illustrated in FIGS. 9*a* and 9*b*, the first magnetizing equipment 901 comprises rotatable elements 903, 904, 905 and 906 (not shown) driven by an electric motor 922. As illustrated in the section view shown in FIG. 9*b*, each of the rotatable elements 903-906 comprises permanent magnets having radially directed magnetic axes. In FIG. 9*b*, one of the permanent magnets of the rotatable element 904 is denoted with a reference number 915. The permanent magnets can be embedded to a support matrix made of non-ferromagnetic material for example aluminum. A part of the support matrix of the rotatable element 904 is denoted with a reference number 916 in FIG. 9*b*. In this exemplifying case, each rotatable element further comprises a ferromagnetic yoke and a support band for supporting and protecting the permanent magnets. In FIG. 9*b*, the yoke of the rotatable element 904 is denoted with a reference number 917 and the support band of the rotatable element 904 is denoted with a reference number 918. The support band can be made of for example carbon fiber or metal.

As shown in FIG. 9*a*, the device comprises also a supply equipment 932 comprising a feed box 920 and a second magnetizing equipment 931. The second magnetizing equipment is positioned so that a concentration gradient of the first particles is formed towards top surface of the mixture on the moving carrier equipment 909.

The rotatable elements 903 and 905 constitute first co-axial rotatable elements which are driven with an electrical motor 922, and the rotatable elements 904 and 906 (not shown) constitute second co-axial rotatable elements which are driven with an electric motor. The first and second rotatable elements are adjacent to each other in the transversal direction of the conveyor belt 909, i.e. the in the x-direction of the coordinate system 999. The first and second rotatable elements are adapted to rotate in mutually opposite rotational directions as illustrated with arrows 924 and 925 in FIG. 9*b*. It is also possible that all the rotatable elements 903-906 are driven with only one motor and with a power transmission arrangement comprising gear wheels, a chain and chain wheels, and/or a belt and belt pulleys. In some cases, where the mutually adjacent first and second rotatable elements are sufficiently close to each other, it may suffice that only the first, or the second, rotatable elements are rotated because the adjacent second, or first, rotatable elements are rotated due to the magnetic interaction between mutually adjacent rotatable elements.

Figure 1B:
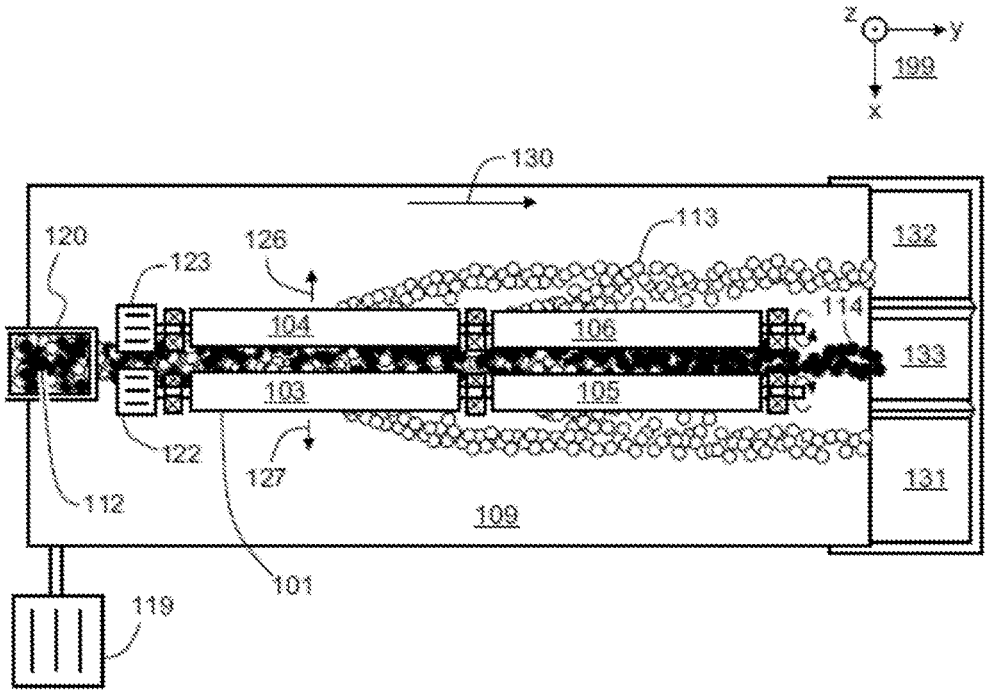
FIG. 1*b* shows a schematic top view of the device illustrated in FIG. 1*a*.
Figure 1C:
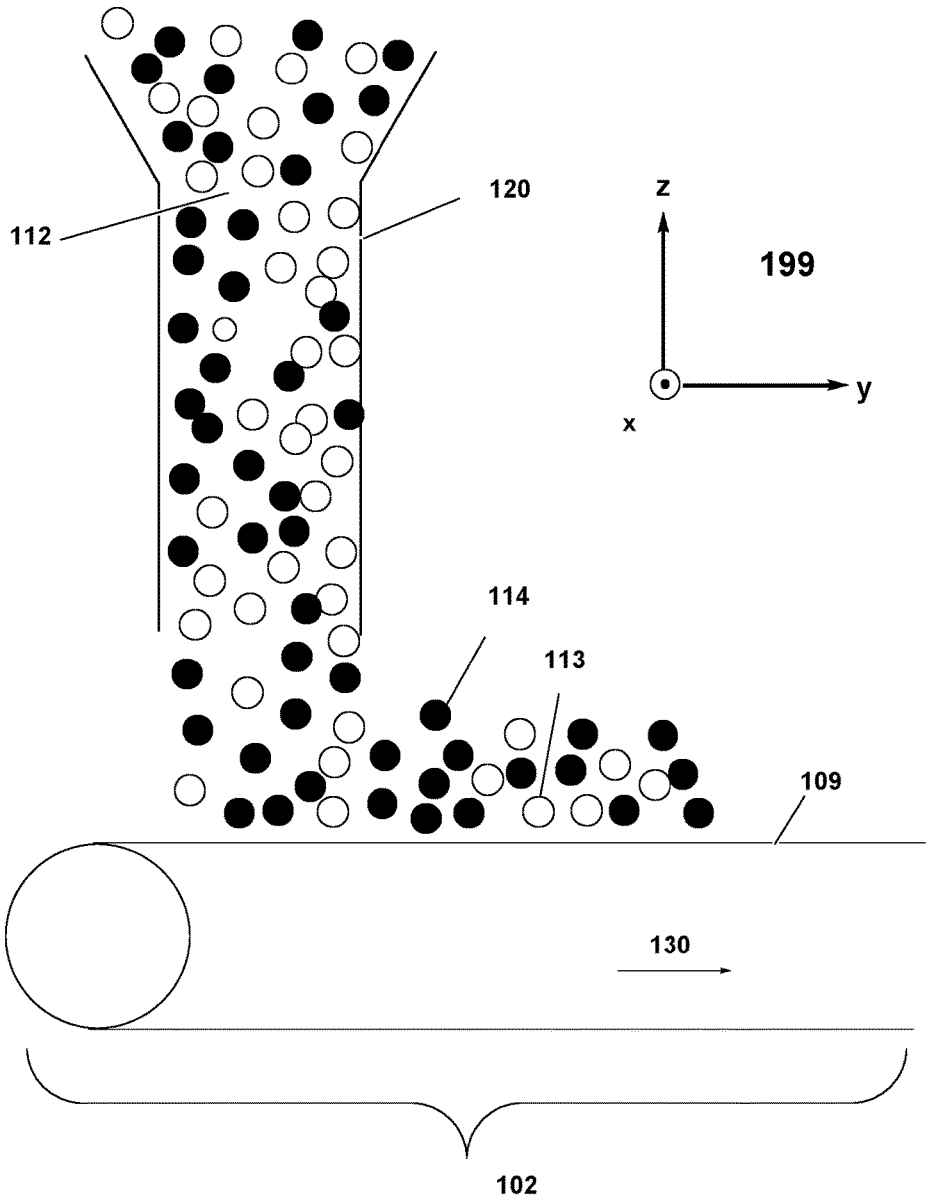
FIG. 1*c* shows a schematic side view of the feed box of the device illustrated in FIGS. 1*a* and 1*b*, FIGS. 2 and 4 illustrate supply equipment and carrier equipment according to exemplifying and non-limiting embodiments of a device of the present invention for separation of first particles in a mixture having the first particles having positive magnetic susceptibility and less magnetic second particles.

FIG. 9*b* shows schematically the mixture which comprises first particles having positive magnetic susceptibility, $\chi>0$, and less magnetic second particles. The first particles can be, for example but not necessarily, hematite, ilmenite or pyrrhotite and the second particles can be for example quartz sand. In FIG. 9*b*, the first particles are presented as white circles one of which is denoted with a reference number 913 and the second particles are presented as black circles one of which is denoted with a reference number 914. As shown in the figure, the first particles are concentrated towards top of the mixture on the conveyor belt. When the rotatable elements are rotating as illustrated by the arrows 924 and 925 shown in FIG. 9*b*, mutually opposite polarity portions of the magnetic field are adapted to sweep the mixture. A loop line 938 shown in FIG. 9*b* illustrates an exemplifying flux line of the magnetic field produced by the rotatable element 904. A part 928 of the loop line represents such a portion of the magnetic field which has polarity so that the field acting on the mixture 912 is substantially upwards, i.e. in the positive z-direction of the coordinate system 999. Correspondingly, a part 929 of the loop line represents such a portion of the magnetic field which has opposite polarity so that the field acting on the mixture 912 is substantially downwards, i.e. in the negative z-direction of the coordinate system 999. The magnetic field produced by the rotatable element 903 sweeps the mixture 912 in a sweeping direction illustrated with an arrow 927 shown in FIG. 9*b*. Correspondingly, the magnetic field produced by the rotatable elements 904 sweeps the mixture 112 in a sweeping direction illustrated with an arrow 926 shown in FIG. 9*b*. As illustrated in FIG. 9*b*, the sweeping magnetic field produced by the rotatable elements 903 deflect the direction of movement of a first portion of the first particles obliquely towards a first longitudinal edge of the conveyor belt 909. Correspondingly, the sweeping magnetic field produced by the rotatable elements 904 deflect the direction of movement of a second portion of the first particles obliquely towards the second longitudinal edge of the conveyor belt 909. The deflected directions of movement of the first particles make it possible to receive the first particles at different collectors as desired. Since the first particles were concentrated towards top of the mixture, prior to receiving the first magnetic equipment, their separation is more effective that by using devices of prior art e.g. that shown in FIGS. 1*a* and 1*b*.

Since the separation of the first particles from the mixture is based on directing magnetic forces to the first particles, the separation is most effective to those of the first particles which are most free, i.e. least hindered by other particles, to move in response to the magnetic forces. Those of the first particles which are located topmost on the trail of the mixture on the conveyor belt 909 are inherently those of the first particles which are most free to be moved by the sweeping magnetic fields. The freedom of all the first particles to move can be increased by agitating the mixture so as to cause the first and second particles to be stirred on the surface of the conveyor belt 909. When a particle belonging to the first particles is e.g. bouncing due to the stirring, the particle is free to be moved at least a short distance by the sweeping magnetic field. When the sweeping by the magnetic field and the bouncing occurs sufficiently many times, the particle under consideration is shifted a sufficient distance in the sweeping direction of the magnetic field. The separation process can be tuned by adjusting the rotational speeds of the rotatable elements 903-906, by adjusting the speed of movement of the conveyor belt 909, and by adjusting the strength of the magnetic fields acting on the mixture. Since the first particles are pre-concentrated to the mixture, a relatively high speed of the conveyor belt can be used. In the exemplifying case illustrated in FIGS. 9*a* and 9*b*, the strength of the magnetic fields can be adjusted by adjusting the vertical distance between the rotatable elements and the conveyor belt. The vertical distance is advantageously so long that the first particles do not stick on the rotatable elements. The peak value of the magnetic flux density acting on the mixture can be for example from 0.01 T to 0.5 T. The support band 918 can be designed to be so thick that a particle belonging to the first particles does not get captured by the rotatable element even if the particle were thrown towards the rotatable element due to the agitation of the mixture.

The exemplifying device illustrated in FIGS. 9*a* and 9*b* comprises advantageously an agitator 910 for agitating the conveyor belt 909 so as to cause the first and second particles to be stirred on the upper surface of the conveyor belt. In this exemplifying case, the agitator 910 comprises ferromagnetic elements adapted to agitate the conveyor belt in response to being shaken by the magnetic field produced by the magnetizing equipment and alternating with respect to the ferromagnetic elements. The ferromagnetic elements can be for example flexible wires or strips of ferromagnetic material which are shaken by the magnetic field alternating with respect to the wires or strips and which in turn agitate the conveyor belt. In FIG. 9*b*, one of the ferromagnetic elements is denoted with a reference number 911.

Figure 10:
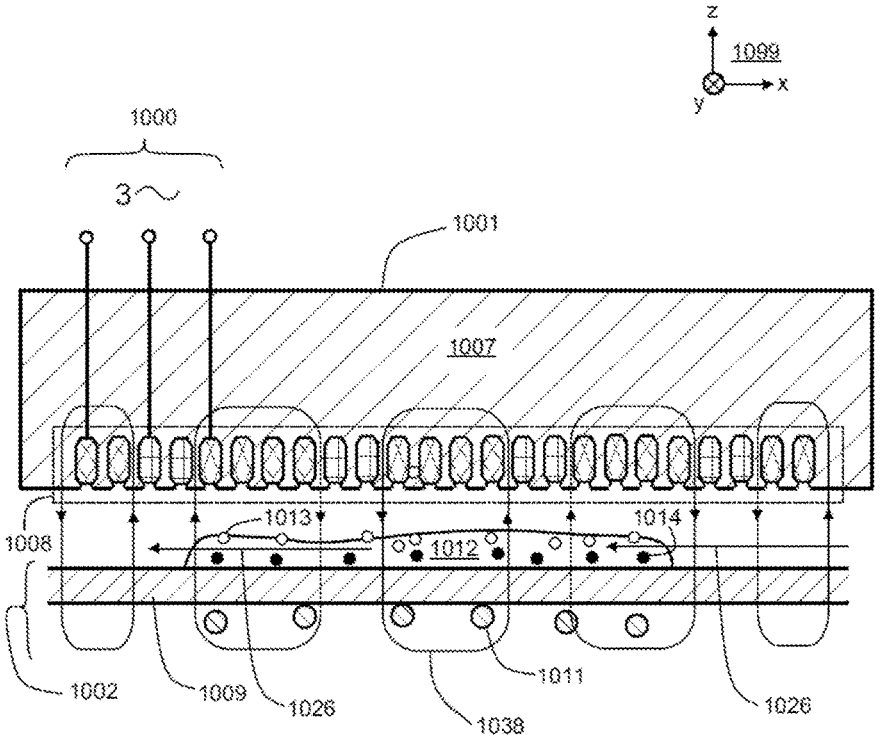
FIG. 10 illustrates a device according to another exemplifying and non-limiting embodiment of the invention for separating particles having positive magnetic susceptibility from less magnetic particles.

FIG. 10 illustrates a device according to another exemplifying and non-limiting embodiment of the invention for separating first particles having positive magnetic susceptibility from mixture 1012 comprising the first particles and nonmagnetic second particles wherein the first particles are concentrated on top of the mixture. FIG. 10 shows a schematic view of a section taken from the device in the same way as FIG. 9*b* shows the schematic view of the section taken along the line A-A shown in FIG. 9*a*. FIG. 10 shows schematically the mixture which comprises first particles having positive magnetic susceptibility, $\chi>0$, and less magnetic second particles. The first particles can be, for example but not necessarily, hematite, ilmenite or pyrrhotite and the second particles can be for example quartz sand. In FIG. 10, the first particles are presented as white circles one of which is denoted with a reference number 1013 and the second particles are presented as black circles one of which is denoted with a reference number 1014. As shown in the figure, the first particles are concentrated towards top of the mixture on the conveyor belt. The device illustrated in FIG. 10 comprises magnetizing equipment 1001 for producing magnetic field acting on the mixture, and carrier equipment 1002 for carrying the mixture so that the mixture is adapted to move with respect to the magnetic field. In this exemplifying case, the carrier equipment 1002 comprises a conveyor belt 1009 for moving the first particles in the y-direction of a coordinate system 1099. The magnetizing equipment 1001 is adapted to produce the magnetic field so that mutually opposite polarity portions of the magnetic field are adapted to sweep the mixture in a sweeping direction which is depicted with arrows 1026 in FIG. 10. The sweeping magnetic field deflects the direction of movement of the first particles towards the sweeping direction and away from a direction of movement of the second particles, i.e. away from the y-direction of a coordinate system 1099.

In the exemplifying device illustrated in FIG. 10, the magnetizing equipment 1001 comprises an electromagnet 1007 that has a multiphase winding 1008. The electromagnet 1007 produces the above-mentioned sweeping magnetic field when multiphase alternating electrical current is supplied to the multiphase winding 1008. A loop line 1038 illustrates an exemplifying flux line of the magnetic field produced by the electromagnet 1007. In this exemplifying case, the multiphase winding 1008 is a 3-phase winding and the multiphase alternating electrical current is 3-phase alternating electrical current. The 3-phase winding can be in principle similar to a stator winding of a 3-phase alternating current electrical motor. It is also possible that a device according to an exemplifying and non-limiting embodiment of the invention comprises one or more rotatable permanent magnet elements such as the rotatable elements 903-906 shown in FIGS. 9*a, b* and also one or more electromagnets such as the electromagnet 1007. The one or more rotatable permanent magnet elements can be on one side of the conveyor belt and the one or more electromagnets can be on the other side of the conveyor belt.

The exemplifying device illustrated in FIG. 10 comprises advantageously an agitator for agitating the conveyor belt 1009 so as to cause the first and second particles to be stirred on the upper surface of the conveyor belt. In this exemplifying case, the agitator comprises ferromagnetic elements adapted to agitate the conveyor belt in response to being shaken by the magnetic field produced by the electromagnet 1007. In FIG. 10, one of the ferromagnetic elements is denoted with a reference number 1011. Since the first particles are pre-concentrated, prior to reaching the first magnetizing equipment 1001, their separation is simpler than by using devices of prior art.

Figure 11:
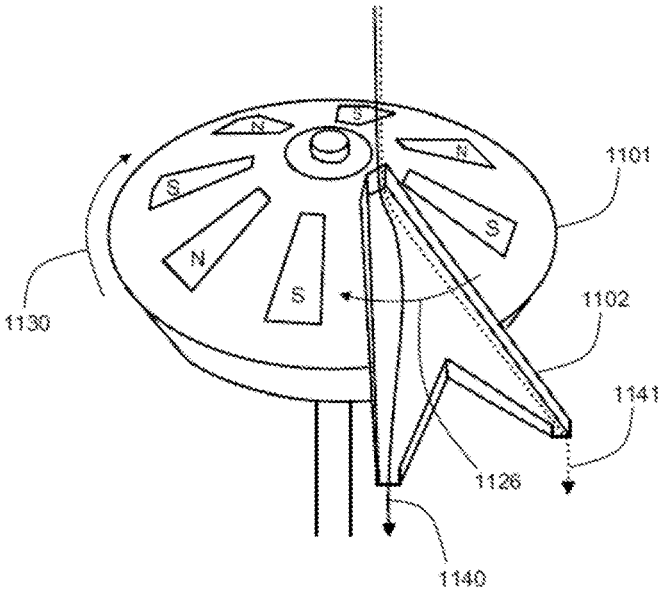
FIG. 11 illustrates a device according to an exemplifying and non-limiting embodiment of the invention for separating particles having positive magnetic susceptibility from less magnetic particles.

FIGS. 11 and 12 illustrate alternative carrier equipments suitable for use in the device according to the present invention. In the exemplifying device illustrated in FIG. 11, the carrier equipment 1102 comprises a sliding surface for allowing the gravity force to move the mixture. The first magnetizing equipment 1101 comprises a wheel provided with permanent magnets which produce the above-mentioned sweeping magnetic field when the wheel is rotated according to an arrow 1130 shown in FIG. 11. FIG. 11 shows schematically first particles having positive magnetic susceptibility, $\chi>0$, and less magnetic second particles. The first particles can be, for example but not necessarily, hematite, ilmenite or pyrrhotite and the second particles can be for example quartz sand. In FIG. 11, the first particles are presented as a solid line with a reference number 1140 and the second particles are presented as dotted line with a reference number 1141. Since the first particles are pre-concentrated prior to receiving to the sliding surface, their separation is enhanced compared to the devices according to prior art.

Figure 12A:
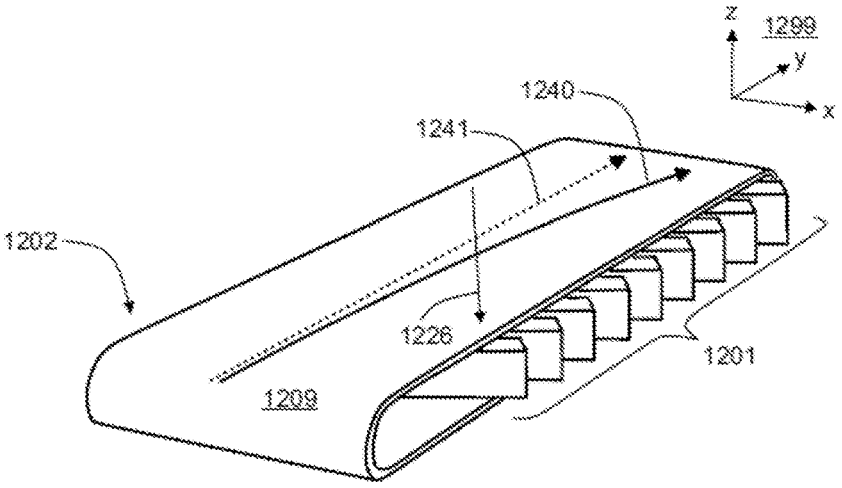
FIGS. 12*a* and 12*b* illustrate a device according to an exemplifying and non-limiting embodiment of the invention for separating particles having positive magnetic susceptibility from less magnetic particles.
Figure 12B:
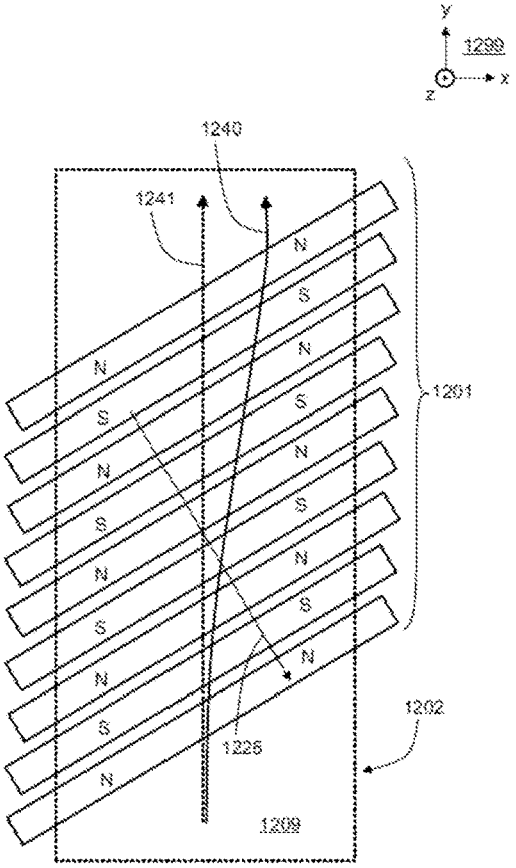

FIGS. 12*a* and 12*b* illustrate a device according to an exemplifying and non-limiting embodiment that comprises the first magnetizing equipment 1201 for producing magnetic field acting on the mixture, and carrier equipment 1202 for carrying the mixture so that the mixture is adapted to move with respect to the magnetic field. In this exemplifying case, the carrier equipment 1202 comprises a conveyor belt 1209 for moving the mixture in the positive y-direction of a coordinate system 1299. The magnetizing equipment 1201 comprises a plurality of bar-shaped permanent magnets whose magnetic axes are substantially perpendicular to the conveyor belt 1209. As shown in FIGS. 12*a* and 12*b*, the permanent magnets are positioned obliquely with respect to the moving direction of the conveyer belt, i.e. obliquely with respect to the y-direction of the coordinate system 1299. As shown in FIG. 12*b*, the north-pole "N" of every second of the permanent magnets is towards the part of the conveyor belt carrying mixture and the south-poles "S" of the rest of the permanent magnets are towards the part of the conveyor belt carrying mixture. When the mixture is moved by the conveyor belt 1209, the magnetic field produced by the permanent magnets sweeps the mixture in a sweeping direction which is depicted with an arrow 1226 in FIGS. 12*a* and 12*b*. The sweeping magnetic field deflects the direction of movement of the first particles towards the sweeping direction and away from a direction of movement of the second particles, i.e. away from the y-direction of a coordinate system 1299. The moving path of the first particles is depicted with a curved arrow 1240, and the moving path of the second particles is depicted with a curved arrow 1241. Since the first particles are pre-concentrated prior to receiving to the sliding surface, their separation is enhanced compared to the devices according to prior art.

Figure 13:
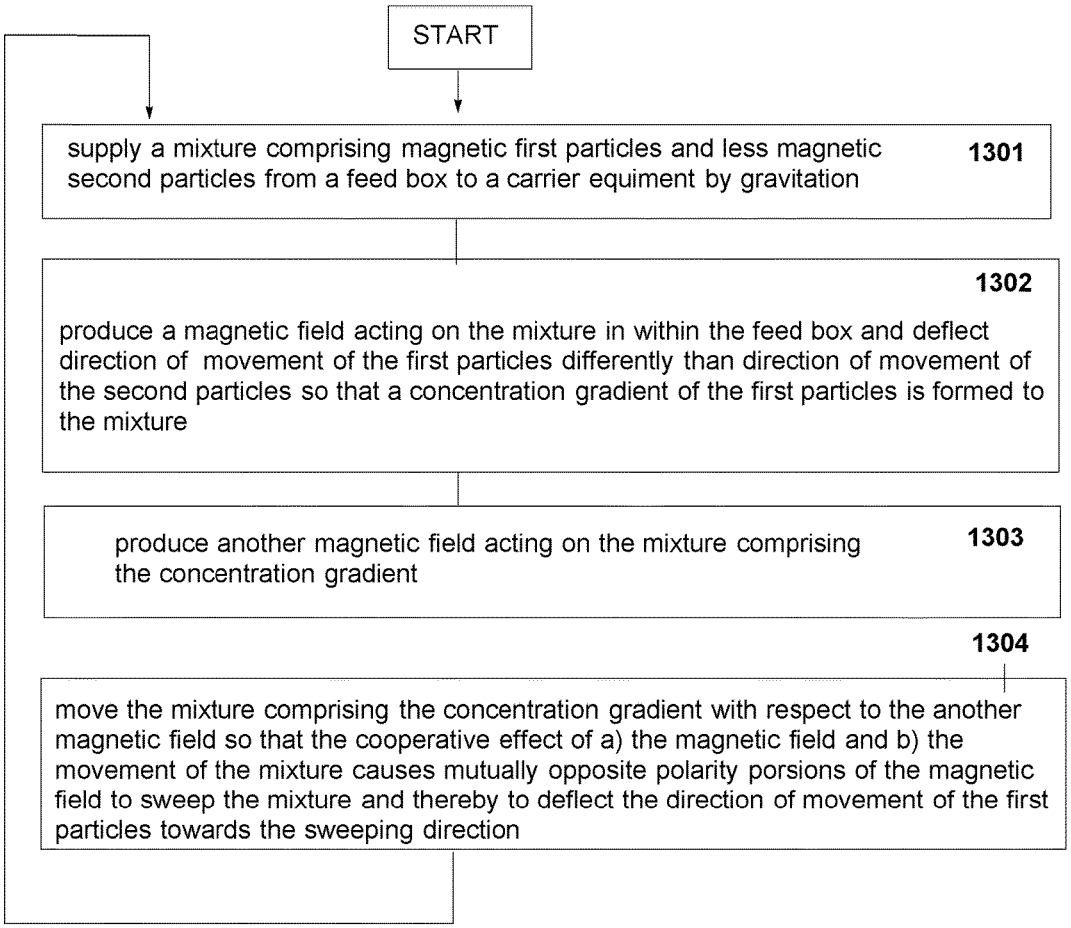
FIG. 13 shows a flowchart of a method according to an exemplifying and non-limiting embodiment of the invention for separating particles having positive magnetic susceptibility.

FIG. 13 shows a flowchart of a method according to an exemplifying and non-limiting embodiment of the invention for separating first particles from mixture comprising the first particles and second particles, each of the first particles having positive magnetic susceptibility and each of the second particles having magnetic susceptibility smaller than that of each of the first particles, the method comprising. The method comprises the following actions:

- action 1301: supplying the mixture from a feedbox to a carrier equipment by gravity
- action 1302: produce a magnetic field acting on the mixture in within the feed box and deflect direction of movement of the first particles differently than direction of movement of the second particles so that a concentration gradient of the first particles is formed to the mixture,
- action 1303: produce another magnetic field acting on the mixture
- action 1304: move the mixture comprising the concentration gradient with respect to the another magnetic field so that the cooperative effect of a) the magnetic field and b) the movement of the mixture causes mutually opposite polarity portions of the magnetic field to sweep the mixture and thereby to deflect the direction of movement of the first particles towards the sweeping direction. In a method according to a preferable embodiment the second magnetic field is produced by the second magnetizing equipment positioned so that the direction of deflection of the first particles is downstream or perpendicular in respect to direction of moving of the mixture on the carrier equipment.

In a method according to an exemplifying and non-limiting embodiment of the invention, the first magnetic field, whose mutually opposite polarity portions sweep the mixture comprising a concentration gradient of the first particles, is at least partly produced with one or more rotating elements each comprising permanent magnets having radially directed magnetic axes.

In a method according to an exemplifying and non-limiting embodiment of the invention, the first magnetic field whose mutually opposite polarity portions sweep the mixture comprising a concentration gradient of the first particles, is at least partly produced with one or more electromagnets each having a multiphase winding supplied with multiphase alternating electrical current.

In a method according to an exemplifying and non-limiting embodiment of the invention, the mixture comprising a concentration gradient of the first particles, is moved with a conveyor belt.

In a method according to an exemplifying and non-limiting embodiment of the invention, the mixture comprising a concentration gradient of the first particles is moved by allowing the gravity force to move the mixture along a sliding surface.

In a method according to an exemplifying and non-limiting embodiment of the invention, the mixture comprising a concentration gradient of the first particles is moved with a conveyor belt and the longitudinal direction of the conveyor belt is substantially parallel with a rotation axis of each of one or more rotating elements which produce the magnetic field whose mutually opposite polarity portions sweep the mixture.

In a method according to a preferable embodiment of the invention, the rotating elements comprise at least one first rotating element and at least one second rotating element so that the first and second rotating elements are adjacent to each other in a transversal direction of the conveyor belt and rotate in mutually opposite rotational directions so as to deflect the direction of movement of a first portion of the first particles obliquely towards a first longitudinal edge of the conveyor belt and the direction of movement of a second portion of the first particles obliquely towards a second longitudinal edge of the conveyor belt.

In a method according to an exemplifying and non-limiting embodiment of the invention, the mixture comprising a concentration gradient of the first particles is moved with a conveyor belt and the longitudinal direction of the conveyor belt is substantially perpendicular to directions of magnetic axes of a multiphase winding of each of one or more electromagnets which produce the magnetic field whose mutually opposite polarity portions sweep the mixture.

In method according to an exemplifying and non-limiting embodiment of the invention further comprises agitating the mixture comprising a concentration gradient of the first particles. The mixture can be agitated for example with the aid of one or more ferromagnetic elements shaken by the magnetic field alternating with respect to the ferromagnetic elements.

In a method according to an exemplifying and non-limiting embodiment of the invention, a peak value of the magnetic flux density acting on the mixture comprising a concentration gradient of the first particles is from 0.01 T to 0.5 T.

In a method according to an exemplifying and non-limiting embodiment of the invention, the material of the particles of the mixture comprises one or more of the following: hematite, ilmenite, ilmenite, pyrrhotite, siderite, chromite, biotite and quartz sand.

The non-limiting, specific examples provided in the description given above should not be construed as limiting the scope and/or the applicability of the appended claims.

What is claimed is:

1. A device for separating first particles from a mixture comprising the first particles and second particles, each of the first particles having positive magnetic susceptibility and each of the second particles having magnetic susceptibility smaller than that of each of the first particles, the device comprising:

first magnetizing equipment for producing a first magnetic field acting on the mixture, carrier equipment for carrying the mixture so that the mixture is adapted to move with respect to the first magnetic field, supply equipment comprising a feed box for supplying the mixture to the carrier equipment with the aid of gravitation, wherein the first magnetizing equipment and the carrier equipment are adapted to:

produce the first magnetic field, and to carry the mixture so that mutually opposite polarity portions of the first magnetic field are adapted to:

sweep the mixture in a sweeping direction and deflect a direction of movement of the first particles towards the sweeping direction and away from a direction of movement of the second particles, the deflected direction of movement of the first particles intersecting the sweeping direction, and wherein the feed box comprises a second magnetizing equipment for producing a second magnetic field for deflecting a direction of movement of the first particles differently than a direction of movement of the second particles when the mixture is moved by the gravitation towards the carrier equipment so as to generate, to the mixture arriving at the carrier equipment, a concentration gradient of the first particles.

2. The device according to claim 1, wherein the second magnetizing equipment is positioned so that the direction of deflection of the first particles is upstream or perpendicular in respect to direction of moving of the mixture on the carrier equipment so that the concentration gradient of the first particles is towards surface of the mixture.

3. The device according to claim 1, wherein the supply equipment is inclined so that the direction of inclination is downstream or perpendicular in respect of the direction of moving of the mixture on the carrier equipment.

4. The device according to claim 3, wherein the angle of inclination $\beta$ is $0° < \beta < 90°$, wherein $\beta$ is the angle between direction of gravity and surface of the carrier equipment when the device is in its operational position.

5. The device according to claim 1, wherein the feed box further comprises an agitator configured to agitate the feed box so as to generate a flow of the mixture within the feed box.

6. The device according to claim 1, wherein, the first magnetizing equipment comprises one or more rotatable elements each comprising permanent magnets having radially directed magnetic axes so as to produce at least a part of the magnetic field acting on the mixture, the mutually opposite polarity portions of the magnetic field sweeping the mixture in response to rotation of the one or more rotatable elements.

7. The device according to claim 6, wherein the device comprising a single electrical motor configured to rotate one the rotatable elements, where the mutually adjacent rotatable elements are sufficiently close to each other so that the adjacent rotatable elements are rotated due to the magnetic interaction between mutually adjacent rotatable elements.

8. A method for separating first particles from a mixture comprising the first particles and second particles, each of the first particles having positive magnetic susceptibility and each of the second particles having magnetic susceptibility smaller than that of each of the first particles, the method comprising:

supplying the mixture from a feedbox to a carrier equipment with aid of gravitation, producing a first magnetic field acting on the mixture on the carrier equipment, moving the mixture on the carrier equipment with respect to the first magnetic field, wherein the producing of the first magnetic field and the moving the mixture with respect to the first magnetic field are carried out so that mutually opposite polarity portions of the magnetic field sweep the mixture in a sweeping direction and deflect a direction of movement of the first particles towards the sweeping direction and differently from a direction of movement of the second particles, the deflected direction of movement of the first particles intersecting the sweeping direction, the method further comprising:

producing a second magnetic field acting on the mixture within the feed box and deflecting a direction of movement of the first particles differently than a direction of movement of the second particles when supplying the mixture by the gravitation towards the carrier equipment, so that the direction of deflection of the first particles is upstream or perpendicular in respect to direction of moving of the mixture on the carrier equipment.

9. The method according to claim 8, the method further comprising agitating the mixture.

10. The device according to claim 3, wherein the angle of inclination $\beta$ is $10° \leq \beta \leq 45°$, wherein $\beta$ is the angle between direction of gravity and surface of the carrier equipment when the device is in its operational position.

* * * * *